United States Patent [19]

Seifert et al.

[11] Patent Number: 4,969,581

[45] Date of Patent: Nov. 13, 1990

[54] UNEQUIVOCAL BOTTOM DELIVERY CONTAINER WITH SELF-SEALING VALVE

[75] Inventors: John A. Seifert, Highland Heights, Ky.; Rocco D. Papalia, Cincinnati, Ohio; Craig F. Sampson, Palo Alto; Christopher Loew, San Francisco, both of Calif.

[73] Assignee: The Procter & Gamble Company, Cincinnati, Ohio

[21] Appl. No.: 391,070

[22] Filed: Aug. 8, 1989

[51] Int. Cl.[5] ..... B65D 47/00

[52] U.S. Cl. ..... 222/212; 222/185; 222/490; 222/494; 222/545; 222/562; 220/254; 220/307

[58] Field of Search ..... 222/173, 181, 184, 185, 222/212, 213, 464, 490, 491, 494, 538; 215/211, 224; 220/254, 307

[56] References Cited

U.S. PATENT DOCUMENTS

| | | | |
|---|---|---|---|
| 1,694,925 | 12/1928 | Morrison . | |
| 2,334,032 | 11/1943 | Rhodes | 65/45 |
| 3,241,726 | 3/1966 | Chester | 222/211 |
| 3,342,379 | 9/2967 | Foley | 222/173 |
| 3,488,002 | 1/1970 | Ming | 222/185 |
| 4,166,553 | 9/1979 | Fraterrigo | 222/181 |
| 4,728,006 | 3/1988 | Drobish et al. | 222/101 |
| 4,749,108 | 6/1988 | Dornsbusch et al. | 222/212 |
| 4,819,829 | 4/1989 | Rosten et al. | 220/346 |

*Primary Examiner*—Andres Kashnikow
*Assistant Examiner*—Philippe Derakshani
*Attorney, Agent, or Firm*—R. C. Witte; J. V. Gorman; M. E. Hilton

[57] ABSTRACT

An unequivocal bottom delivery package with a self sealing valve for storing and dispensing a fluid material. The package has a shipping configuration in which a shipping cap is located over the self sealing valve to provide leakage resistance during shipment. Upon receipt it is obvious that operation of the package first necessitates removal of the shipping cap. Removal of the shipping cap transforms the package into a dispensing configuration. The dispensing configuration provides easy one step dispensing and makes it obvious that the container is intended to be stored with the self sealing valve between uses. A travel cap is provided for placement over the self sealing valve, transforming the package into a traveling configuration, which provides leakage resistance during subsequent transportation. It is obvious the package is not intended to be placed into the travelling configuration between every use.

20 Claims, 4 Drawing Sheets

UNEQUIVOCAL BOTTOM DELIVERY CONTAINER WITH SELF-SEALING VALVE

BACKGROUND OF THE INVENTION

1. FIELD OF THE INVENTION

The present invention relates to containers for storing and dispensing fluid materials, and more particularly, to bottom delivery containers with self sealing valves.

2. DESCRIPTION OF THE PRIOR ART

Traditionally, fluid materials, including laundry detergents and shampoo, have been provided to consumers in top delivery containers. Consequently, top delivery containers are extremely familiar to the average consumer. These top delivery containers stand upright and deliver their contents through dispensing orifices located in the top of the container and disposed upwardly. The dispensing opening is generally sealed by some sort of cap between uses. The cap prevents contaminants from falling into the container through the upwardly disposed dispensing opening. Also, the cap prevents spillage of the contents if the container is inadvertently knocked over.

To dispense the fluid material from one of these traditional containers requires several steps. A consumer must first remove the cap, usually by unscrewing or operating a flip top. The consumer must then invert the container and wait for the fluid material to flow to the dispensing opening. The length of the wait varies depending upon the viscosity of the fluid, the distance the fluid must travel, and the amount of fluid within the container. After waiting for the fluid material to flow to the dispensing opening the consumer generally squeezes the container to dispense the desired amount of fluid material. This squeezing step is particularly necessary if a small opening, as found on most flip-top caps, is used with a relatively viscous fluid material. The consumer must then upright the container which allows the fluid material to flow back toward the container bottom. Lastly, the consumer must recap the container to avoid the above-mentioned contamination and spillage problems. All totaled, four or five steps are required.

More recently, bottom delivery containers with self sealing valves have been suggested for storing and dispensing fluid materials. Such a container is disclosed in U.S. Pat. No. 4,749,108 issued June 7, 1988 to Dornbusch et. al. This patent discloses a container with a self sealing valve. The container has a hook which can be used to hang the container in the inverted position. The container also has a flip top cap to provide added resistance to fluid material leakage. U.S. Pat. No. 4,728,006 issued Mar. 1, 1988 to Drobish et. al. discloses another container with a self sealing valve which can be reinforced by a snap-on cap. The container may either be hung or stood in the inverted position.

These self sealing containers can, if used properly, provide many benefits to a user. The user, upon receiving the container removes the cap exposing the self sealing valve. The container is then hung from the hook with the self sealing valve disposed downwardly. To dispense from these containers is a one-step process. The consumer merely grasps the container with one hand, places the other hand under the container and squeezes the container until the desired quantity of fluid material is dispensed into the second hand. Due to the bottom delivery feature of the container there is no need to invert the container immediately prior to dispensing and consequently, there is no need to wait for the fluid material to flow to the self sealing valve. This latter problem is particularly aggravating to consumers if a relatively viscous fluid material is used and the container is substantially empty.

Unfortunately, these self sealing containers generate confusion and, therefore, do not provide their benefits to the vast majority of consumers. For example, in a consumer test utilizing a container as disclosed in the previously mentioned patent to Dornbusch et al., only 16% of the consumers operated the package correctly. It seems many consumers have an inherent belief that containers must be stored between uses with the dispensing opening capped and disposed upwardly. Apparently these consumers did not believe the self sealing valve would actually prevent leakage between usages if the container were left uncapped with the dispensing opening disposed downwardly. Others apparently did not notice the presence of a bottom dispensing benefit at all. Consequently, the container was stored with the self sealing valve disposed upwardly. Also, many consumers capped and uncapped the container between each use. The vast majority of the consumers, therefore, did not realize all the benefits provided by the container.

The structure of the package of the present invention is unequivocal. In other words, there is only one obvious way to use the package. Used correctly the package provides all its benefits to the consumer and there is disincentive to use the container in any other, incorrect, way. If the consumer were to operate the package incorrectly he would be aware that he was not using the package as intended. Several features of the package eliminate confusion and virtually insure that the consumer receives all the benefits provided by the container. For example, the package, when full, will not rest in the inverted position with the dispensing opening disposed upwardly. Additionally, the arrangement, presentation, indicia, and shape of the caps make it obvious that the container is not intended to be capped between uses.

Accordingly, it is an object of the present invention to provide a storage and dispensing package for fluid material which insures that the advantages of the bottom delivery package with a self sealing valve are realized by the vast majority of consumers, i.e., it is unequivocal.

More specifically, it is an object of the present invention to provide such a storage and dispensing package which:

Has substantial added leakage protection during shipment to the ultimate user;

Permits easy, one-handed, one-step dispensing of the fluid material from the first use to the last;

Virtually dictates storage of the package between uses in the upright position, i.e., with the dispensing opening disposed downwardly;

Makes it obvious that the package need not be and should not be capped between uses;

Has an auxiliary travel cap which can be used to provide added leakage protection after initial use of the container if the package is to be subsequently transported;

Stores the auxiliary travel cap out of the way when it is not in use, thereby preventing its loss; and Which accomplishes the aforementioned at minimal cost.

SUMMARY OF THE INVENTION

In accordance with one aspect of the present invention a bottom delivery package is provided for storing and dispensing a fluid material. The bottom delivery package has a shipping configuration which provides leakage resistance during shipment, a dispensing configuration which permits one step dispensing of the fluid material, and a traveling configuration which provides leakage resistance during subsequent transportation. The package includes a resiliently deformable container with a tubular side wall for housing the fluid material. The tubular side wall exhibits a degree of flexibility sufficient to permit the deformation thereof in response to manual forces applied thereto. The tubular side wall also has a degree of resilience sufficient to return automatically to its undeformed condition when the manually applied forces are removed therefrom. The container also has a top wall with means for inhibiting storage of a package in the inverted position and a bottom wall. A tubular base section is attached to the bottom of the container. The base is hollow and adapted to enclose the bottom wall of the container. The base section also has an open lower end circumscribed by a bottom edge adapted to support the package on a resting surface. A valve assembly depends from the bottom wall of the container and has a self sealing valve incorporated therein. The self sealing valve is adapted to open in response to the manual forces applied to the tubular side wall of the container permitting the discharge of the fluid material and to automatically close, terminating the discharge after removal of the manual forces. A discardable shipping cap is removably affixed to the valve assembly over the self sealing valve in the shipping configuration to provide leakage resistance. The shipping cap is detachable from the valve assembly to place the package in the dispensing and traveling configurations. A travel cap is releasably retained on the bottom wall of the container within the base and adjacent the valve assembly in both the shipping and dispensing configurations. The travel cap is adapted for placement on the valve assembly over the self sealing valve providing leakage resistance when the package is in the traveling configuration.

BRIEF DESCRIPTION OF THE DRAWINGS

While the specification concludes with claims which particularly point out and distinctly claim the invention, it is believed the present invention will be better understood from the following description in conjunction with the accompanying drawings in which:

DESCRIPTION OF THE PREFERRED EMBODIMENT

The present invention provides for a bottom delivery package for storing and dispensing fluid materials. The package has three configurations. A shipping configuration which prohibits leakage during shipment of the filled package to the ultimate consumer, a dispensing configuration for enabling simple one step dispensing, and a travel configuration for providing added leakage resistance during transportation after initial dispensing. The overall structure of the package ensures its proper use in each configuration, thereby ensuring the consumer receives all its benefits.

Figure 1:
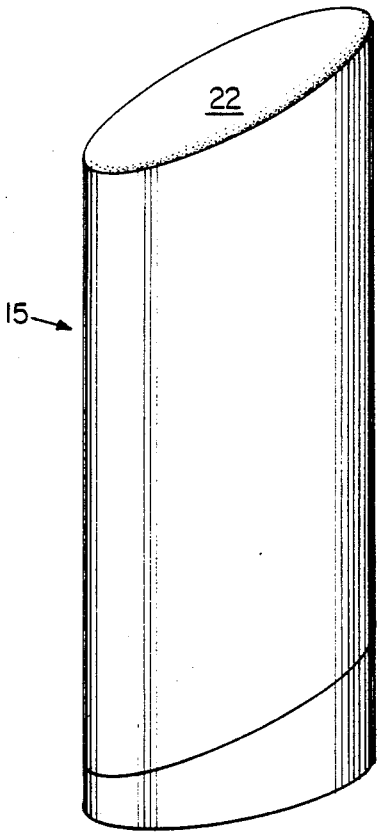
FIG. 1 is a perspective view of the package of the preferred embodiment as the consumer receives it.
Figure 2:
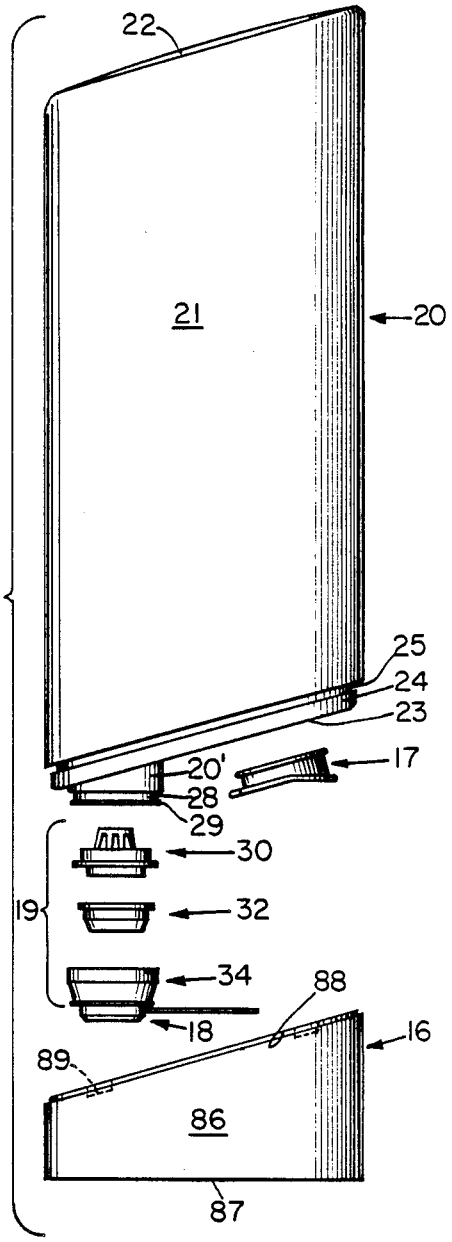
FIG. 2 is an exploded elevation view showing the constituent parts of the package of the preferred embodiment.

In a particularly preferred embodiment shown in FIG. 1, the present invention provides a bottom delivery package, indicated generally as 15, for storing and dispensing fluid materials. Referring to FIG. 2, the package 15 consists of a container 20, a valve assembly 19, a shipping cap 18, a travel cap 17 and a base 16. The container 20 is preferably blow molded from polyethylene, although other flexible materials such as polyvinyl chloride, polypropylene, polycarbonate, polystyrene, vinyls and olefins can also be used. The container 20 has a resilient tubular side wall 21 of elliptical cross section, a sloped top wall 22 and a sloped bottom wall 23. The top wall 22 and the bottom wall 23 are both sloped at the same angle relative to the tubular side wall 21. Together these walls 21, 22, and 23, give the container 20 a generally parallelogram-shaped elevational view as viewed from the front. The top wall 22, in addition to being sloped has a slight radius of curvature which prevents the package 15 from resting thereon when the container 20 is substantially full. The bottom wall 23 is circumscribed by a shoulder portion 24 and is connected to the sidewall 21 along a groove 25 which aids attachment to the base 16 section as discussed below. In addition, as seen best in FIG. 8 and FIG. 9, a recessed area 14 is located in the higher portion of the sloped bottom wall 23. Referring to FIG. 2, a container neck 20' depends from the lower portion of the sloped bottom wall 23. In the preferred embodiment a dispensing opening is located at the end of the container neck 20'. A groove 28 circumscribes the neck 20' near its distal end leaving a ridge 29 circumscribing the neck 20' at its distal end.

Figure 8:
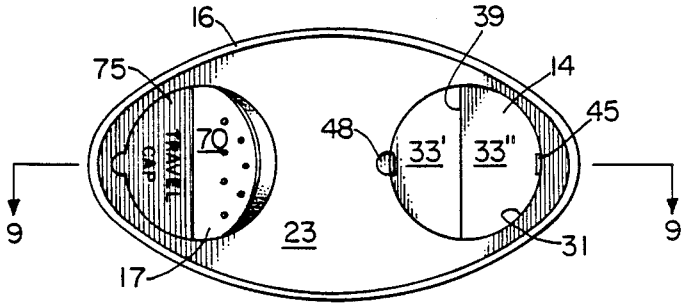
FIG. 8 is a plan view from the bottom of the package of the preferred embodiment showing the package as configured for travel subsequent to initial use.
Figure 9:
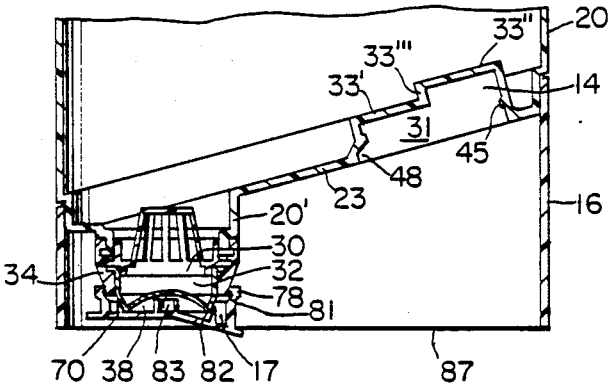
FIG. 9 is a fragmentary vertical-section taken along line 9—9 of FIG. 8.

The preferred recessed area 14, seen best in FIG. 8 and FIG. 9, located in the higher portion of the bottom wall 23 of the container 20 has a generally cylindrical side wall 31 and a bilevel bottom wall 33. Each level of the bottom wall, the shallow level 33' and the deep level 33'' is semicircular. The bilevel wall 33 includes the wall 33''' perpendicular to the two levels of the bottom wall 33' and 33''. This perpendicular wall 33''' forms an outer corner 39 where it intersects the upper level 33'. Two tabs 45 are located on the cylindrical side wall 31 opposing each other. Each tab 45 is horizontally a slight distance away from the surface of the shallow level 33' of the bottom wall 33. Vertically, the tabs 45 are located such that an imaginary line drawn through the center of each tab 45, in plan view, would go through the center of the outer corner 39 and be perpendicular thereto. This imaginary line would also go through a semi-circular recessed area 48 which is part of the overall recessed area 14.

Figure 5:
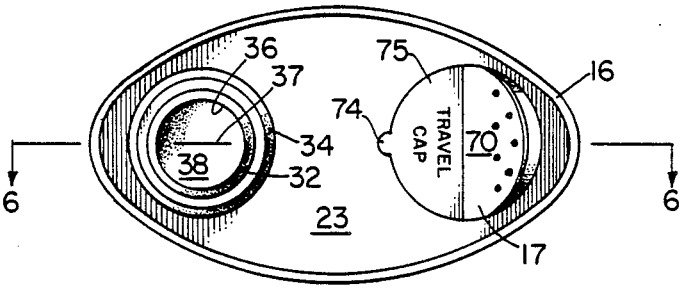
FIG. 5 is a plan view from the bottom of the package of the preferred embodiment showing the package as configured between uses.
Figure 10:
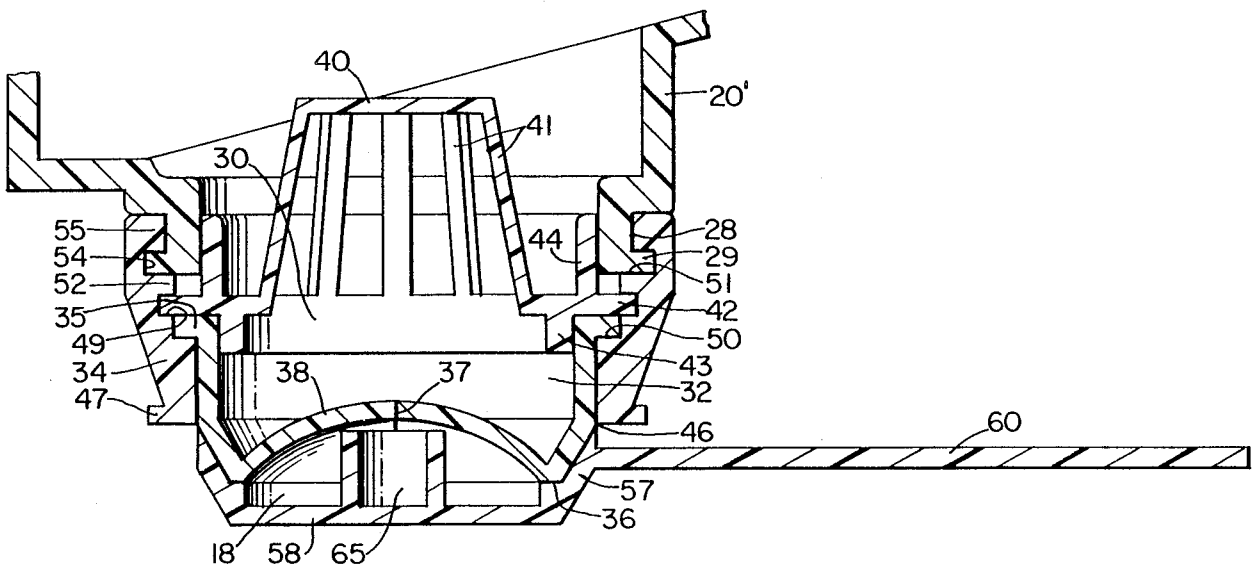
FIG. 10 is a greatly enlarged fragmentary vertical-section similar to the bottom left-hand portion of FIG. 4.

Referring to FIG. 2 and FIG. 10, preferably permanently attached by a snap-fit to the neck 20' of the container 20 surrounding the dispensing opening is the self sealing valve assembly 19. This assembly 19 consists of a flow restrictor 30, a self sealing valve 32, and an annular collar 34. The self sealing valve 32 of the preferred embodiment is identical to that disclosed in U.S. Pat. No. 4,749,108 issued to Dornsbusch el al., on June 7, 1988. Other suitable self sealing valves 32 are disclosed in U.S. Pat. No. 4,728,006 issued to Drobish et al. on Mar. 1, 1988, and the disclosures of both these patents relative to the structure of self-sealing valves are incorporated herein by reference. As seen in FIG. 10, the self sealing valve 32 of the preferred embodiment is made of silicone and has an annular flange 35 which is connected to a cylindrical wall segment which adjoins a conical wall segment. This conical wall segment intersects a centrally located concave wall 38 forming an annular rim 36. Also, as best seen in FIG. 5, the concave wall 38 has a single linear slit 37 therein.

With continuing reference to FIG. 10, the flow restrictor 30 is injection molded of polypropylene and may also be made of other suitable materials such as, polyvinyl chloride, polycarbonate, polystyrene, polyethylene. The flow restrictor 30 is also disclosed in U.S. Pat. No. 4,749,108 and the disclosure thereto is hereby also incorporated herein by reference. The flow restrictor 30 consists of a circular top wall 40 which has several spokes 41 equally spaced therearound and extending therefrom in a conical orientation. Attached to the other end of the spokes 41 is a horizontal annular flange 42. A vertical annular projection 43 depends from the horizontal annular flange 42. A second vertical annular projection 44 is attached to the horizontal annular flange 42 and extends upwardly.

The annular collar 34 is preferably injection molded integrally with the shipping cap 18 of low density polyethylene or other suitable materials such as polyvinyl chloride, polypropylene, polycarbonate, polystyrene, vinyls and olefins. Although the shipping cap 18 is integrally molded with the annular collar 34 (a part of the valve assembly) the shipping cap 18 is not considered part of the valve assembly 19. An annular line of weakness 46, as seen in conjunction with FIG. 4, separates the shipping cap 18 from the collar 34. The exterior surface of the collar 34 is a generally cylindrical surface adjoining a generally conical surface. At the small end of the conical surface is a protruding annular ridge 47. Interiorly, the collar 34 has a series of annular ledges. There is an inner annular ledge 49, a middle annular ledge 50, and an outer annular ledge 51 from which four equally spaced retaining tabs 52 project inwardly. Immediately above the outer annular ledge 51 is an annular groove 54 and immediately above the annular groove 54 is an annular ridge 55 which is at the end of the collar 34.

Combined these pieces, the self sealing valve 32, flow restrictor 30, and collar 34 form the self sealing valve assembly 19. The self sealing valve 32 is located inside the collar 34 with the concave wall 38 near the travel cap 17 when attached and with the annular flange 35 of the self sealing valve 32 resting upon the middle annular ledge 50 of the collar. Immediately adjacent the annular flange 35 of the self sealing valve 32 is the horizontal annular flange 42 of the flow restrictor 30. The vertical annular projection 43 depending from the horizontal annular flange 42 projects into the interior of the cylindrical portion of the self sealing valve 32. The vertical annular upward projection 44 extends into the interior of the container neck 20' The outer edge of the horizontal annular flange 42 of the flow restrictor 30 is held by the four retaining tabs 52 located on the collar 34. Combined these pieces are the valve assembly 19.

Figure 3:
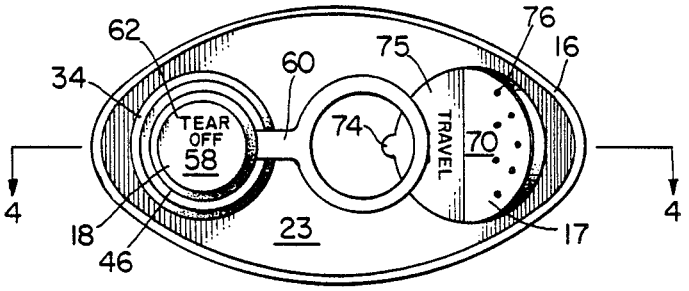
FIG. 3 is a plan view from the bottom of the package of the preferred embodiment showing the package as delivered to the consumer.

With continuing reference to FIG. 10, the shipping cap 18 has externally a generally tubular wall 57 with a cylindrical segment and a conical segment and closed at its distal end by an end wall 58. Attached to the tubular wall 57 is, as seen in FIG. 3, a pull ring 60 which includes a linear member and an annular member. Located on the end wall 58 is indicia 62 (FIG. 3) for conveying to the consumer that the shipping cap 18 should be separated from the collar 34 prior to use of the container 20. The indicia 62 of the preferred embodiment includes the words "tear off". The interior dimensions of the shipping cap 18 generally conform to the exterior dimensions of the self sealing valve 32. Therefore, when the shipping cap 18 is attached to the collar 34 it prevents the self sealing valve 32 from deforming outwardly. Depending from the nd wall 58 of the shipping cap 18 is also an inner annular projection 65 whose distal end is in close proximity to wall 38 of the self sealing valve 32 when the shipping cap 18 is attached to the collar 34. In this arrangement the shipping cap 18 prevents inversion of the self sealing valve 32 and, consequently, leakage through the self sealing valve 32 during shipping.

Figure 4:
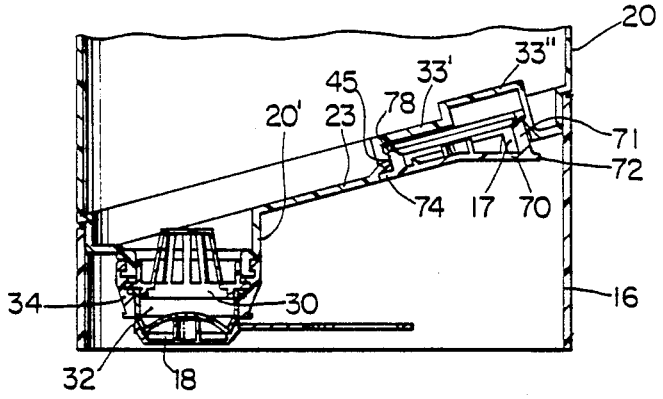
FIG. 4 is a fragmentary vertical-section taken along line 4—4 of FIG. 3.

Referring to FIG. 4, the travel cap 17 is generally cylindrical exteriorly with a top wall 70, half of which perpendicular to the cylindrical wall 71 and the other half sloped at an acute angle thereto. The top wall 70 extends slightly beyond the cylindrical wall 71 forming a lip 72. Referring to FIG. 3, attached to the lip 72 on the perpendicular (or flat) portion of the top wall 70 is, a semi-circular tabular protrusion 74. Also, the flat half of the top wall 70 contains indicia 75 for conveying to the consumer that this cap 17 is for use only in transporting the package 15. The indicia 75 of the preferred embodiment includes the words "travel cap". The sloped portion of the top wall 70 contains a visual pattern 76 which indicates the location where pressure should be applied to release the travel cap 17. As seen in FIG. 4, at the base of the cylindrical wall is an annular ridge 78.

Figure 6:
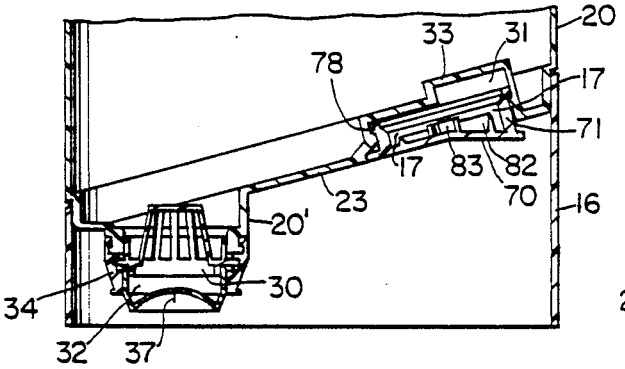
FIG. 6 is a fragmentary vertical-section taken along line 6—6 of FIG. 5.

Referring to FIG. 6, interiorly, the travel cap 17 has an outer annular projection 82 whose interior dimension conforms to the exterior dimensions of the self sealing valve 32 depending from the top wall 70. As seen in FIG. 9, when the travel cap 17 is attached to the self sealing valve assembly 19, this outer annular projection 82 prevents the self sealing valve 32 from deforming outwardly. An inner annular projection 83 also depends from the top wall 70 and is in close proximity to the wall 38 of the self sealing valve 32 when the travel cap 17 is attached to the collar 34. Consequently, the travel cap 17, when attached helps maintain the self sealing valve 32 in its sealed condition thereby avoiding leakage during transportation of the package 15.

Referring to FIG. 2 in conjunction with FIG. 5, the base 16 is a hollow elliptical tubular wall 86 with no top or bottom walls. The tubular wall 86 of the base 16, when viewed from the front has an elevational view which has a generally trapezoidal shape. The bottom edge 87 of the base is perpendicular to the axis of base 16 and therefore supports the tubular wall 86 in vertical condition when resting on a horizontal surface. The top edge 88 of the base is sloped at an oblique angle relative to the tubular wall 86 of the base 16. The base 16, therefore, has a bottom edge 87 perpendicular to the tubular wall 86 and a top edge 88 sloped relative to the tubular wall 86. The angle of this top edge 88 is the same, relative to the tubular wall 86 of the base 16, as the top wall 22 and the bottom wall 23 of the container 20 relative to its tubular wall 21. At the top edge 88 of the base are four inwardly protruding tabs 89 which snap into the groove 25 of the container 20 for attachment. The base 16 is preferably injection molded of polypropylene, although other suitable materials, such as polyvinyl chloride, polyethylene, polycarbonate, polystyrene vinyls and olefins, may be used. Of course the base 16 can be integrally molded with the container 20.

Initially, the package 15 must be filled with fluid material and assembled into the shipping configuration, seen in FIG. 3 and FIG. 4. There are several methods possible for accomplishing this filling and assembling operation. In one example, the container 20 is first filled through the dispensing opening and then the package 15 is assembled. In another method, the package 15 is completely assembled first and then the container 20 is filled through a second opening (not shown) which is later plugged. Regardless of the method, the package 15 is filled with fluid material at some point and assembled into the shipping configuration.

Assembly into the shipping configuration is relatively simple and the order of assembly is, again, relatively unimportant. The top edge 88 of the base 16 is telescoped onto the shoulder 24 of the container 20 with the four tabs 89 interlocking with the groove 25 on the container 20. Consequently, when the base 16 and container 20 of the preferred embodiment are attached to each other the tubular wall 21 of the container 20 and the tubular wall 86 of the base 16 are vertical, axial, and aligned with each other. The valve assembly 19, is permanently snap fit onto the neck 20' of the container 20. The annular ridge 29 and groove 28 of the neck 20' of the container 20 cooperate with the annular ridge 55 and groove 54 of the collar 34 to provide this snap fitting attachment. The shipping cap 18 is in place over the self sealing valve 32. Lastly, the travel cap 17 is inserted into the recessed area 14. This recessed area 14 is, seen best in FIG. 8 and FIG. 9, adapted to releasably hold the auxiliary travel cap 17. The preferred means for releasably holding the travel cap 17 comprises the two opposing tabs 45 discussed earlier. As seen in FIG. 5 and FIG. 6, the opposing tabs 45 cooperate with the annular flange 78 on the travel cap 17 to releasably retain the travel cap 17. The travel cap 17 is oriented such that the semi-circular protrusion 74 extends into the semi-circular portion 48 of the recessed area, seen in FIG. 8. This insures that the sloped portion of the top wall 70 of the travel cap 17 is located over the deep level 33'' of the bilevel recessed area. Once inserted the annular flange 78 of the travel cap 17 is adjacent the shallow level 33' of the recessed area. This annular flange 78 cooperates with the retaining tabs 45 on the interior of the cylindrical wall 31 of the recessed area to retain the travel cap 17. Thus, the vertical distance from the shallow level 33' of the recessed area 14 to the most extended portion of the retaining tabs 45 is slightly greater than the height of the annular flange 78 of the travel cap 18.

The ultimate consumer receives the package 15 in the shipping configuration and converts it to the dispensing configuration, seen in FIG. 5 and FIG. 6. This conversion is a simple process as it is obvious to the consumer and merely requires the consumer to remove the shipping cap 18. The process is obvious because the pull-ring 60 of the shipping cap 18, as seen in FIG. 3, visually overlays the travel cap 17. Thus, the consumer realizes that the shipping cap 18 must be dealt with prior to the travel cap 17. In addition, the shipping cap 18 is imprinted with the words "tear off" 62. As discussed above, the shipping cap 18 is molded as part of the collar 34 of the valve assembly 19 and differentiated, as seen in FIG. 10, by a line of weakness 46. The consumer simply grasps the pull ring 60 which visually overlays the travel cap 17 and pulls; separating the shipping cap 18 from the valve assembly 19 but leaving the annular collar 34, which holds the self sealing valve 32 and flow restrictor 30 in place. With the shipping cap 18 removed the package 15 is in the dispensing configuration, seen in FIG. 5 and FIG. 6.

Once in the dispensing configuration the consumer places the package 15 on a resting surface with the transverse bottom edge 87 of the base 16 down. The consumer is virtually required to place the package 15 valve 32 down since the slope and curvature of the top wall 22 prevents the package 15 from resting on the top wall 22 when the container 20 is substantially full. As the container 20 empties the center of gravity adjusts and the package 15 will stand "inverted". At this point, however, the consumer's tendency to place the package 15 valve up will have been overcome. Assuming the consumer elects to place the full package 15 on its side, at least the consumer will be aware that that is not the way the package 15 is intended to be stored. It is believed that the inability to rest the package 15, at least initially, on the top wall 22 will encourage the consumer to at least try to store the package 15 on a resting surface with the transverse bottom edge 87 of the base 16 down and discover the benefits. Oriented in this manner the valve assembly 19 is disposed downwardly, depending from the container 20, and ready for dispensing.

Dispensing the fluid material from this package 15 is an extremely simple one handed, one step operation. The consumer merely grasps and raises the package 15 with one hand while placing the other hand under the dispensing opening 37 and manually applies a force to the resilient tubular side wall 21 of the container 20 until the required amount of fluid material is dispensed. Additionally, there is no need to invert the package 15 immediately prior to dispensing. The fluid material in the container 20 rests immediately adjacent the self sealing valve 32. Therefore, there is no need to wait for the fluid material to flow to the dispensing opening 37 as required with conventional containers. The slope of the bottom wall 23 insures the fluid material will be adjacent the self sealing valve 32 regardless of the amount of fluid material remaining in the container 20 thereby creating easy dispensing to the last ounce of fluid. There is also no need to deal with capping and uncapping the container each time the package 15 is used to dispense fluid material.

Figure 7:
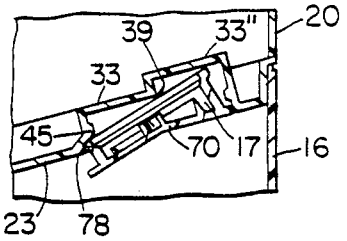
FIG. 7 is a fragmentary detail-section showing the travel cap being removed from the recessed area.

At some point after the shipping cap 18 has been removed, the consumer may desire to transport the package 15 to another location (for example on a trip). To transport the package 15 without leakage, the consumer transforms the package into its travel configuration, seen in FIG. 8 and FIG. 9. Although the self sealing valve 32 provides adequate resistance to leakage between uses as the package 15 rests on a surface, the travel configuration provides added resistance to leakage for transportation. To make the conversion the consumer simply removes the travel cap 17, as seen in FIG. 7, from the recessed area 14 in the bottom wall 23 of the container 20 by pressing the angled half of the top wall 70 inwardly. Since the angled half of the top wall 70 is over the deep level 33" of the recessed area 14 the travel cap 17 pivots on the outer corner 39 of the bottom wall 33. As the travel cap 17 pivots the annular ridge 78 moves past the tab 45 on the cylindrical side wall 31 of the recessed area. Released by the tab 45, the travel cap 17 simply falls out into the hand of the consumer. The consumer then simply press fits the travel cap 17 onto the collar 34. The travel cap 17 is adapted to be press fit onto the collar 34 of the self sealing valve assembly 19. The annular ridge 47 of the collar 34 of the valve assembly 19 rides past the annular ridge 78 of the travel cap 17 and rests in the annular groove 81 of the travel cap 17. Similar to the shipping cap 18, the annular depending projections 82 and 83 of the travel cap 17 help prevent leakage from the self sealing valve 32 during transit. Thus, the travel cap 17 reinforces the self sealing valve 32 during transit providing added protection against leakage.

Upon arrival at the destination the travel cap 17 is removed and replaced in the recessed area 14 restoring the package 15 to its dispensing configuration, seen in FIG. 5 and FIG. 6. Removal of the travel cap 17 is insured because, as seen in FIG. 9, the angled portion of the top wall 70 of the travel cap 17 extends past the transverse edge 87 of the base 16. Therefore, the package 15 can not rest flat on its transverse edge 87 with the travel cap 17 in place over the self sealing valve 32. The travel cap 17 must first be removed. Although it is possible to stand the package 15 upright, partially on its transverse edge 87 with the travel cap 17 in place, the consumer will again be aware that this is not how the package 15 is intended to be used. The protruding travel cap 17 performs the same function between uses, encouraging the consumer not to place the travel cap 17 on the self sealing valve 32 between each use. This avoids defeating the no wait benefit of the package.

While a particular embodiment of the present invention has been shown and described, modification may be made to the package without departing from the teachings of the present invention. Accordingly, the present invention comprises all embodiments within the scope of the appended claims.

What we claim is:

1. A bottom delivery package for storing and dispensing a fluid material and having a shipping configuration which provides leakage resistance during shipment, a dispensing configuration which permits one step dispensing of said fluid material, and a traveling configuration which provides leakage resistance during subsequent transportation, comprising:

(a) a resiliently deformable container having a tubular side wall for housing said fluid material, said tubular side wall exhibiting a degree of flexibility sufficient to permit deformation thereof in response to manual forces applied thereto and a degree of resilience sufficient to return automatically to its undeformed condition when said manually applied forces are removed therefrom, said container further having a top wall with means for inhibiting storage of said package in the inverted position and a bottom wall;

(b) a tubular base attached to the bottom of said container, said base being hollow and adapted to enclose the bottom wall of said container, said base section further having an open lower end circumscribed by a bottom transverse edge adapted to support said package on a resting surface;

(c) a valve assembly depending from the bottom wall of said container having a self-sealing valve incorporated therein, said self sealing valve in said dispensing configuration being adapted to open in response to said manual forces applied to said tubular side wall of said container permitting the discharge of said fluid material and to automatically close, terminating said discharge, following removal of said manual forces;

(d) a discardable shipping cap removably affixed to said valve assembly over said self-sealing valve in said shipping configuration providing leakage resistance, said shipping ca being detachable from said valve assembly to place said package in said dispensing and said traveling configurations; and (e) a travel cap releasably retained on the bottom wall of said container within said base and adjacent said valve assembly in both said shipping and said dispensing configurations, said travel cap being adapted for placement on said valve assembly over said self sealing valve providing leakage resistance in said traveling configuration.

2. A bottom delivery package according to claim 1 wherein said travel cap in said travel configuration protrudes past said transverse edge of said base section preventing the container from resting completely on said transverse edge when said package is in the traveling configuration.

3. A bottom delivery package according to claim 1 wherein said shipping cap has a pull ring extending therefrom which visually overlays said travel cap.

4. A bottom delivery package according to claim 1 wherein said shipping cap has indicia for conveying to the consumer that said shipping cap is to be removed and discarded; and wherein said travel cap has indicia for conveying to the consumer that said travel cap is intended for use during transportation.

5. A bottom delivery package according to claim 1 wherein said base and said container are integrally molded.

6. A bottom delivery package according to claim 2 wherein said shipping cap has a pull ring extending therefrom which visually overlays said travel cap.

7. A bottom delivery package according to claim 6 wherein said shipping cap has indicia for conveying to the consumer that said shipping cap is to be removed and discarded; and wherein said travel cap has indicia for conveying to the consumer that said travel cap is intended for use during transportation.

8. A bottom delivery package according to claim 1 wherein said container has a sloped bottom wall and said valve assembly is located on the lower portion of said bottom said travel cap is releasably retained on the upper portion of said sloped bottom wall in said shipping and said dispensing configurations.

9. A bottom delivery package according to claim 6 wherein said container has a sloped bottom wall and said valve assembly is located on the lower portion of said bottom said travel cap is releasably retained on the upper portion of said sloped bottom wall in said shipping and said dispensing configurations.

10. A bottom delivery package according to claim 7 wherein said container has a sloped bottom wall and said valve assembly is located on the lower portion of said bottom said travel cap is releasably retained on the upper portion of said sloped bottom wall in said shipping and said dispensing configurations.

11. A bottom delivery package according to claim 8 wherein said container has a generally parallelogram shaped elevation view, said general parallelogram shape being formed by an axially aligned tubular sidewall and a sloped top and bottom wall, said top wall also having a slight curvature which together with said top wall's slope provides said means for inhibiting storage of said container in the inverted position when said container is substantially full.

12. A bottom delivery package according to claim 1 wherein said valve assembly is formed from several components and wherein said shipping cap is integrally molded with at least one component of said valve assembly with a line of weakness permitting said shipping cap to be manually torn away from said valve assembly.

13. A bottom delivery package according to claim 6 wherein said valve assembly is formed from several components and wherein said shipping cap is integrally molded with at least one component of said valve assembly with a line of weakness permitting said shipping cap to be manually torn away from said valve assembly.

14. A bottom delivery package according to claim 7 wherein said valve assembly is formed from several components and wherein said shipping cap is integrally molded with at least one component of said valve assembly with a line of weakness permitting said shipping cap to be manually torn away from said valve assembly.

15. A bottom delivery package according to claim 12 wherein said valve assembly includes a collar having an interior annular ledge and a multiplicity of equally spaced retaining tabs, a self sealing valve with an annular flange, said annular flange of said self sealing valve being adjacent said interior annular ledge of said collar, and a flow restrictor having a top wall with several equally spaced spokes therearound and extending therefrom in a conical orientation, attached to the other end of said spokes being a horizontal annular flange, said horizontal annular flange being adjacent said annular flange of said self sealing valve and retained by said retaining tabs.

16. A bottom delivery package according to claim 13 wherein said valve assembly includes a collar having an interior annular ledge and a multiplicity of equally spaced retaining tabs, a self sealing valve with an annular flange, said annular flange of said self sealing valve being adjacent said interior annular ledge of said collar, and a flow restrictor having a top wall with several equally spaced spokes therearound and extending therefrom in a conical orientation, attached to the other end of said spokes being a horizontal annular flange, said horizontal annular flange being adjacent said annular flange of said self sealing valve and retained by said retaining tabs.

17. A bottom delivery package according to claim 14 wherein said valve assembly includes a collar having an interior annular ledge and a multiplicity of equally spaced retaining tabs, a self sealing valve with an annular flange, said annular flange of said self sealing valve being adjacent said interior annular ledge of said collar, and a flow restrictor having a top wall with several equally spaced spokes therearound and extending therefrom in a conical orientation, attached to the other end of said spokes being a horizontal annular flange, said horizontal annular flange being adjacent said annular flange of said self sealing valve and retained by said retaining tabs.

18. A bottom delivery package according to claim 8 wherein said travel cap is retained in said shipping and said dispensing configuration in a bilevel recessed area by protrusions on said container which cooperate with a ridge and valley on said travel cap such that a force applied manually to a portion of said travel cap will release said travel cap.

19. A bottom delivery package according to claim 9 wherein said travel cap is retained in said shipping and said dispensing configuration in a bilevel recessed area by protrusions on said container which cooperate with a ridge and valley on said travel cap such that a force applied manually to a portion of said travel cap will release said travel cap.

20. A bottom delivery package according to claim 10 wherein said travel cap is retained in said shipping and said dispensing configuration in a bilevel recessed area by protrusions on said container which cooperate with a ridge and valley on said travel cap such that a force applied manually to a portion of said travel cap will release said travel cap.

* * * * *